US005372558A

United States Patent [19]

Perry et al.

[11] Patent Number: 5,372,558

[45] Date of Patent: Dec. 13, 1994

[54] EXERCISE DEVICE

[76] Inventors: Deborah A. Perry, 7 Hillcrest Rd., Woburn, Mass. 01801; Donald L. Gammon, 115 Abbot St., Woburn, Mass. 01810

[21] Appl. No.: 142,619

[22] Filed: Oct. 25, 1993

Related U.S. Application Data

[62] Division of Ser. No. 831,500, Feb. 5, 1992, Pat. No. 5,284,458.

[51] Int. Cl.[5] ..... A63B 21/02

[52] U.S. Cl. ..... 482/49; 482/93; 482/121; 482/148

[58] Field of Search ..... 482/121, 122, 126, 140, 482/904, 911, 148, 49, 92, 93, 99, 100, 116, 129

[56] References Cited

U.S. PATENT DOCUMENTS

| | | |
|---|---|---|
| 680,556 | 8/1901 | Wieland . |
| 4,211,403 | 7/1980 | Coffaro et al. . |
| 4,469,325 | 9/1984 | Ware . |
| 4,717,145 | 1/1988 | Chinimis . |
| 4,770,414 | 9/1988 | Fredrickson et al. . |
| 4,863,162 | 9/1989 | Neckamm et al. . |
| 4,883,269 | 11/1989 | Shaver . |
| 4,940,227 | 7/1990 | Coffey . |

FOREIGN PATENT DOCUMENTS

| | | |
|---|---|---|
| 5807390 | 1/1992 | Australia . |
| 1044299 | 8/1981 | U.S.S.R. . |
| 1085606 | 9/1981 | U.S.S.R. . |
| 1417896 | 8/1988 | U.S.S.R. . |

*Primary Examiner*—Richard J. Apley
*Assistant Examiner*—Jerome W. Donnelly
*Attorney, Agent, or Firm*—Damon J. Borrelli

[57] ABSTRACT

An exercise apparatus for strengthening the muscles of the upper body and arms includes a handle means, a connecting means, and a bias means or counterweight system. The connecting means is telescopically positioned within the handle means. The bias means, or counterweight system, provides the resistive force desired during a work-out period.

8 Claims, 3 Drawing Sheets

EXERCISE DEVICE

CROSS-REFERENCE TO PARENT APPLICATION

This is a divisional application of application Ser. No. 07/831,500, filed Feb. 5, 1992, now U.S. Pat. No. 528,445.

BACKGROUND OF THE INVENTION

1. Field of the Invention

The present invention relates to exercise apparatuses. More particularly, the invention is directed to an abdominal, upper body and arm exercise apparatus of the resistive type.

2. Description of the Prior Art

Health awareness has led to increased exercising particularly by jogging, bicycling, and rowing. Aerobic exercising devices have been developed to simulate the exercise provided by these activities. The use of aerobic exercise devices is preferred as they can provide a continuous, steady work-out at a convenient location, for example, at home or at an exercise facility. These exercise devices are typically equipped with a device that provides a resistive force to a particular movement.

The strengthening and toning of the muscle groups of the abdomen, arms, and upper torso is often a primary objective of the exercise regimen of most individuals. Unfortunately, however, many arm exercises, and the machines designed to simulate them, can, over time, have an adverse impact on a person's elbow and shoulder joints. Further, even when properly done most exercises fail to provide sufficient exercise of those specific muscles of the abdomen, arm, and upper torso which are susceptible to fatty tissue build-up. Indeed, most exercises provide at best a generalized strengthening and toning of all the muscles of the abdomen and upper body.

A need has arisen for an exercise device designed to strengthen and tone the muscle groups of the abdomen, arms, and upper torso.

SUMMARY OF THE INVENTION

It is an object of the present invention to provide an exercise apparatus that does not suffer from the foregoing disadvantages and limitations.

It is a further object of the present invention to provide a resistive exercise apparatus that is economical to manufacture and that provides a method for the strengthening and toning of the muscle groups of the abdomen, arm and upper torso.

It is yet a further object of the present invention to provide a resistive exercise apparatus which provides a plurality of different resistive forces.

The exerciser of the present invention is characterized by a handle means, a connecting means, and either a bias means or counterweight system. The connecting means is telescopically positioned within the handle means.

In general, the handle means includes a first portion, extending longitudinally along a first axis, affixed to a second tubular portion. The second portion is typically positioned such that it is substantially perpendicular to the first portion. The handle means preferably includes a locking means that is configured to engage the connecting means. The locking means serves to maintain the handle and connecting means in selected disposition. Structurally, the locking means generally includes an aperture which extends through the handle means and a pin sized and shaped to be positionable within the aperture. In operation, the pin is positioned in the aperture of the handle means as well as one of a series of apertures in the connecting means.

The connecting means is telescopically positioned within the hollow interior of the second portion of the handle means such that it is both extensible and retractable. Extension and retraction provides a means for regulating the degree of difficulty of the given exercise performed, that is, the amount of resistive force against which a user performs his or her motion. That portion of the connecting means which is proximal to the handle means after assembly of the apparatus of the invention preferably includes a securing means, for example, a series of apertures. These apertures cooperate with the locking element of the handle means to secure the connecting and handle means in relative disposition. That portion of the connecting means that is distal to the handle means after assembly of the apparatus of the invention also preferably includes a securing means. This latter securing means, however, is utilized to attach the connecting means to the bias means or counterweight system. In general, this securing means includes a shackle element to which an end of the bias means, or a wire extending from the counterweight system, can be removably and replaceably attached.

The bias means, for example, an elastic corded material, provides the desired resistive force for operation of the invention. It is configured such that one end can be operatively connected and disconnected to an immobile platform while the opposing end is operatively connectable and disconnectable to and from the connecting means. Attachment to the connecting means is accomplished using the above-described securing means. In operation, movement of the handle and connecting means relative to the immobile platform forces the bias means to stretch thus providing the desired resistance.

Alternatively, a counterweight system including an counterweight slidably positioned on a platform and a wire means can be included in the invention. One end of the wire means operatively connected to the counterweight. The other end of the wire is operatively connectable and disconnectable to and from the connecting means. Attachment to the connecting means is accomplished using the securing means. In operation, movement of the handle and connecting means relative to the platform housing the counterweight produces a tension in the wire means. In particular, movement of the handle and connecting means produces a movement of the counterweight against gravity producing a tension in the wire and thus resistance to movement. The overall weight of the counterweight can be increased or decreased to provide adjustment of the tensioning/resistive force.

Other general and specific objects of the invention will in part be obvious and will in part appear hereinafter.

The invention accordingly comprises the method and apparatus embodying the steps, features of construction, combinations of elements and arrangements of parts adapted to effect such steps, as exemplified in the following detailed disclosure. The scope of the invention is indicated in the claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
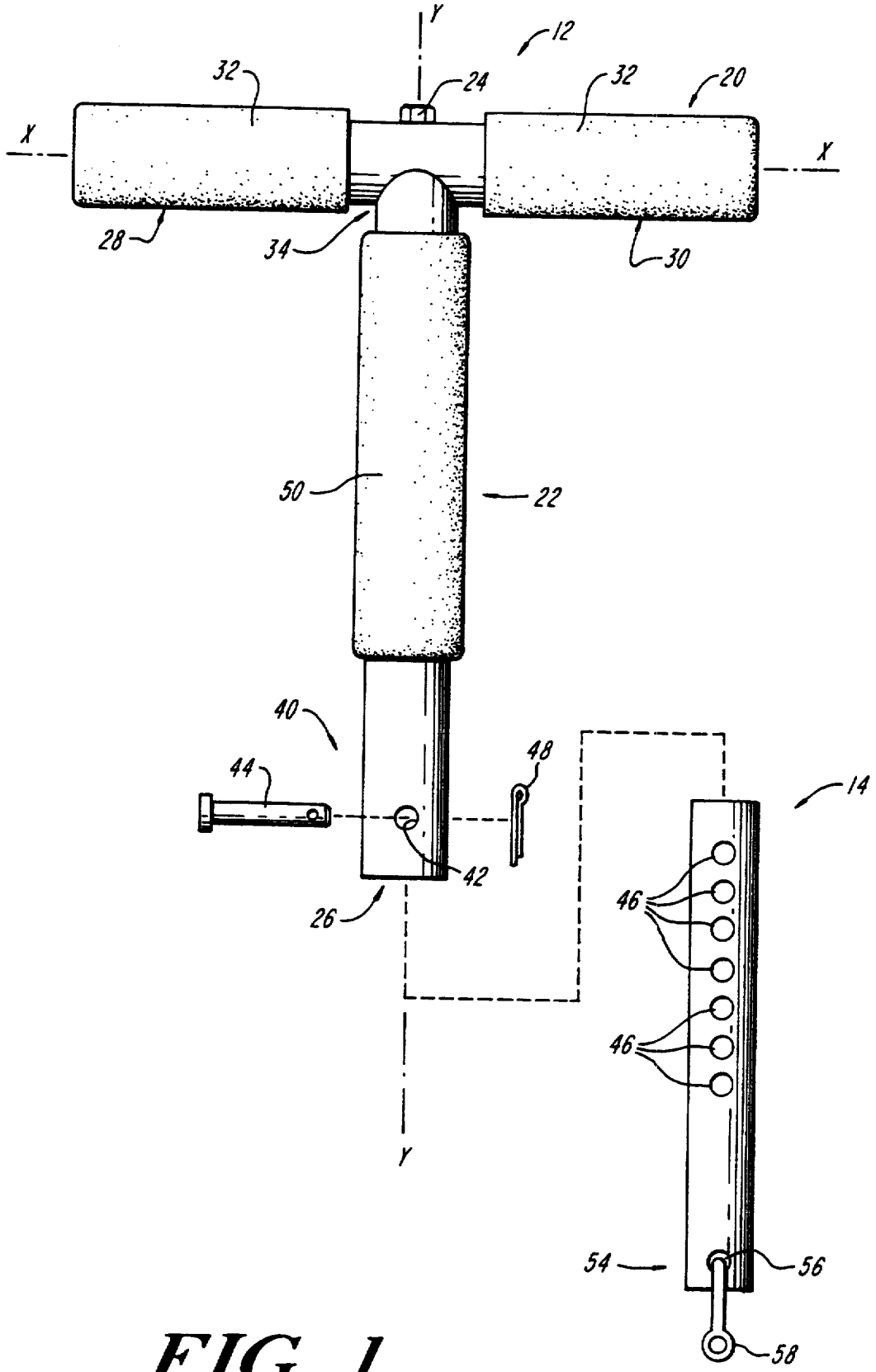
FIG. 1 is an exploded view of the handle and connecting means of an exercise apparatus made in accordance with the teachings of the present invention.

Referring now to FIGS. 1 through 4 wherein like reference numerals refer to like parts, there is illustrated an exercise apparatus 10 embodying the present invention. The exercise apparatus 10 includes a handle means 12, a connecting means 14, and either a bias means 16 or counterweight system 18.

The handle means 12 includes a first portion 20 and a second portion 22. The first portion 20 extends longitudinally along a first axis denoted "X" in FIGS. 1 and 2. The second portion 22 extends longitudinally along a second axis denoted "Y" in FIGS. 1 and 2. Typically, the first and second potions 20 and 22 are connected such that the first portion can freely rotate about the axis "Y" and, thus, adjust for a each user's method of holding the handle means 12. Accordingly, the first and second portions 20 and 22 can be connected together using, for example, a pin or bolt 24. Preferably the portions 20 and 22 are connected such that the axis "X" and the axis "Y" are substantially perpendicular to each other.

Figure 2:
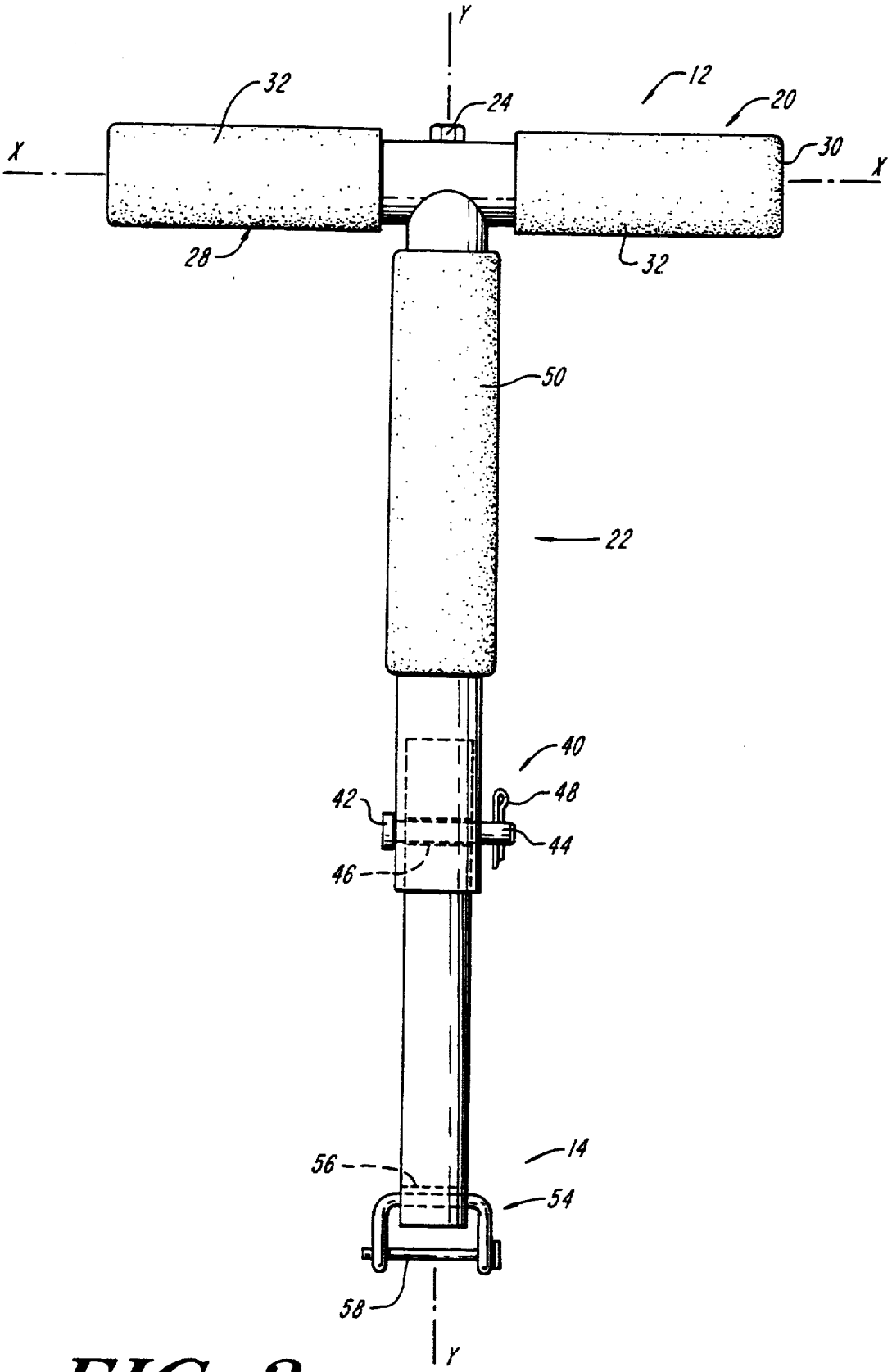
FIG. 2 is a side view of the handle and connecting means of the exercise apparatus of FIG. 1 after being fully assembled.

Referring to FIGS. 1 and 2, the first portion 20 includes hand holds 28 and 30 useful for grasping the apparatus 10. The hand holds 28 and 30 extend out equal distances from the point of connection between the first portion 20 and second portion 22. Typically, the hand holds 28 and 30 are covered with a non-slip material 32, for example, rubber, neoprene, or textured plastic. The first portion 20 can be constructed of virtually any strong, durable material, such as aluminum, stainless steel, or polymeric composites.

The second portion 22 is a tubular member having an open end 26 and a closed end 34. The closed end 34 is connected to the first portion 20 via a bolt or pin 24 as described above, The inside dimension of the second portion 22 is sized and shaped to receive the connecting means 14. The second portion 22 is generally two to three times longer than the first portion 20. More particularly, second portion 22 typically has a length of between fifteen and eighteen inches whereas the first portion 20 is normally between five and six inches long. During use, the outer surface of the second portion 22 serves as a second hand-hold. Accordingly, a non-slip material 50, for example, rubber, neoprene, or textured plastic, is used to cover a portion of the outer surface of the second portion 22. Preferably, a locking means 40 is positioned proximate to the open end 26 of second portion 22. The locking means 40 typically includes an aperture 42 cut into opposing walls of the second portion 22. The aperture 42 is preferably sized and shaped to receive a locking pin or bolt 44. Alternatively, the aperture 42 can be sized and shaped to interferingly engage a recessed, spring-loaded locking pin (not shown) positioned in the connecting means 14. When used, the pin 44 is placed into the aperture 42 and one of the apertures 46 in the connecting means 14. Once positioned in the apertures 42 and 46, the pin 44 is secured using a nut or cotter pin 48. The second portion 22 can be constructed of virtually any strong, durable material, such as aluminum, stainless steel, or polymeric composites.

The connecting means 14 typically is a rod constructed of virtually any strong, durable material, such as aluminum, stainless steel, or polymeric composites. It is sized and shaped such that it can be telescopically extended and retracted into, and out of, the hollow interior of the second portion 22 of the handle means 12.

That portion of the connecting means 14 which is proximal to the handle means 12 after assembly of the apparatus 10 typically includes a series of apertures 46. As explained above, the apertures 46 typically cooperate with the aperture 42 and pin 44 of the locking means 40 to secure the handle means 12 and connecting means 14 in selected disposition. Alternatively, the apertures 46 can contain recessed, spring-loaded locking pins (not shown) which engage the aperture 42 of the locking means 40. The spring-loaded locking pins, when used, are depressed to permit sliding of the connecting means 14 relative to the handle means 12. Of course, in this latter embodiment, utilization of the pin 44 is unnecessary. Adjustment of the length of that portion of the connecting means 14 extending out of the second portion 22, and hence the overall length of the handle and connecting means 12 and 14, provides a means for increasing or decreasing the amount of overall resistive force, and hence exercise, provided by the apparatus 10. After adjustment, a non-slip material (not shown), for example, rubber, neoprene, or textured plastic, can be used to cover the exposed portion of the outer surface of the connecting means 14.

That portion of the connecting means 14 which is distal to the handle means 12 after assembly of the apparatus 10 includes a securing means 54. The securing means 54 includes an aperture 56 cut into the connecting means 14 and a connector 58. The connector 58 typically is a shackle element sized and shaped to be positionable in aperture 56 as well as receive the end of the bias means 16 or wire means 72 of the counterweight system 18. In operation, a portion of the connector 58 is first slipped through the aperture 56. Subsequently, a looped end of the bias or wire means 16 or 72 is connected to the connector 58.

Figure 3:
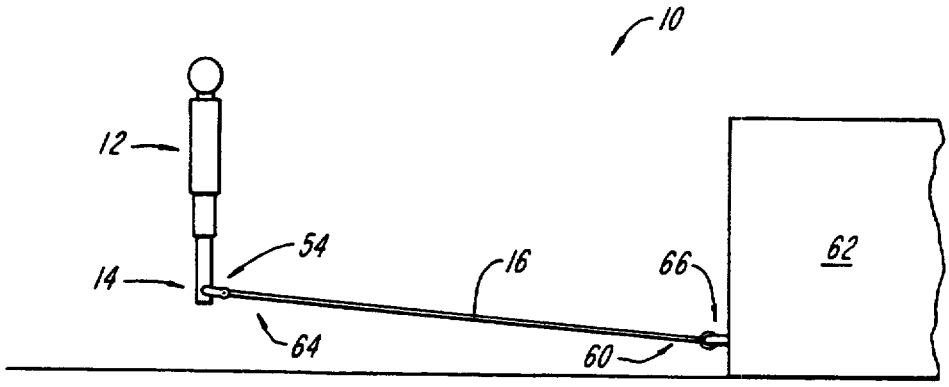
FIG. 3 is a side view of an exercise apparatus in accordance with the invention having a bias means which provides the desired resistive force; and, FIG. 4 is a side view of an exercise apparatus in accordance with the invention having a counterweight system which provides the desired resistive force.

As shown in FIG. 3, in one embodiment of the invention a bias means 16 is utilized to provide the desired resistive force. The bias means 16 typically is an elastic corded material. Those skilled-in-the-art, however, will appreciate that virtually any assembly providing a spring-like resistance, i.e., resistance against stretching, can be used in this embodiment of the invention. The bias means 16 has a first end 60, that can be operatively connected and disconnected to an immobile platform 62, and a second end 64, that is operatively connectable and disconnectable to and from the connecting means 14. More particularly, the second end 64 is connected and disconnected to and from the connecting means 14 via the securing means 54. The first end 60 is affixed to the immobile platform 62 using an appropriate connection assembly 66 familiar to those skilled-in-the-art. Typically, the bias means 16 is about eighteen to twenty-four inches in length when relaxed. Those skilled-in-the-art will appreciate that the bias means 16 can, however, be of virtually any length so as to adapt to the needs of each user. The particular bias means 16 used during a work-out period is selected so that it provides the desired level of resistance for the user. Such a selection may be done empirically.

In operation, movement of the handle and connecting means 12 and 14 relative to the immobile platform 62 forces the user to stretch the bias means 16. As the bias means 16 stretches, its elasticity produces a resistive force. It is the user's work against the resistive force of the bias means 16 which provides the desired level of exercise. The bias means 16 can be selected so as to provide a constant or increasing level of resistance in response to movement of the handle and connecting means 12 and 14.

Figure 4:
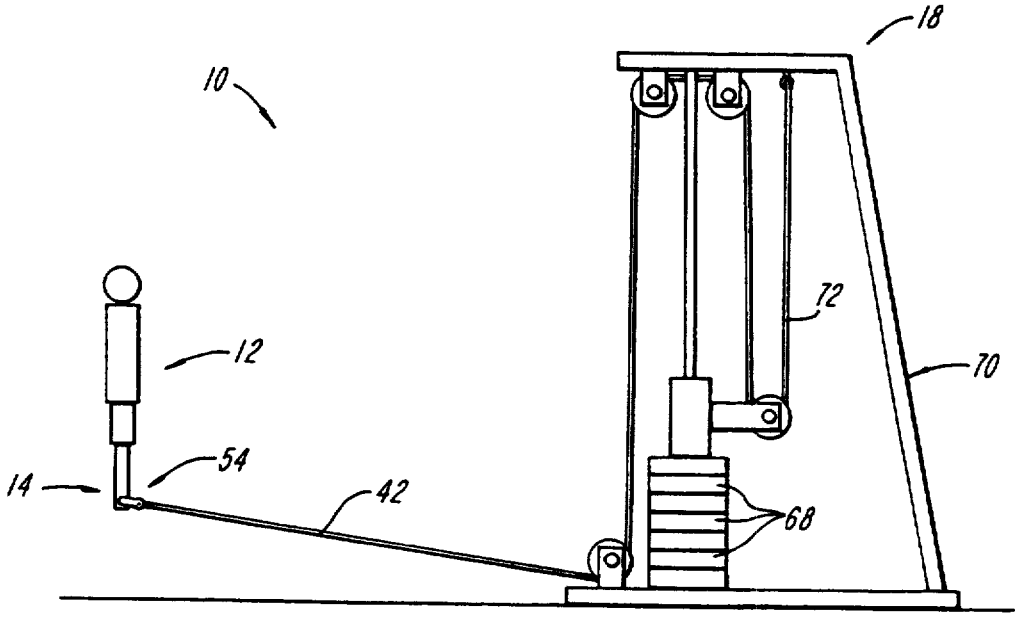

Referring now to FIG. 4, in a second embodiment of the invention the counterweight system 18 is utilized to provide the desired resistive force. The counterweight system 18 includes a stack of counterweights 68 slidably positioned on a platform 70 and a wire means 72. The wire means 72 may be manufactured from virtually any strong wire or corded material. One end of the wire means 72 is operatively connected to a portion of the stack of counterweights 68. The other end of the wire 72 is operatively connectable and disconnectable to and from the connecting means 14. More particularly, attachment to the connecting means 14 is accomplished using the securing means 54. In order to provide the desired amount of resistive force, and hence exercise, the counterweight system 18 typically includes counterweights 68 having a variable total weight of up to two hundred pounds. More particularly, the overall weight of those counterweights 68 used during a given exercise session can be adjusted so that varying degrees of exercise can be performed during a single work-out.

In operation, movement of the handle and connecting means 12 and 14 relative to the platform 70 housing the counterweights 68 produces a tension in the wire means 72. In particular, movement of the handle and connecting means 12 and 14 produces a movement of the counterweights 68 against gravity. This movement, in turn, produces a tension in the wire means 72 and thus resistance. By selectively connecting and disconnecting counterweights 68 to and from the stack, and hence wire means 72, the overall amount of resistive force provided by the counterweight system 18 can be adjusted as desired.

In general, to use the apparatus 10 of the invention, the user first selects the level of resistance against which he or she desires to exercise. This first step is accomplished by selecting an appropriate bias means 16 or overall weight of counterweights 68. Next, the bias means 16 or counterweight system 18 is connected as required to the connecting means 14 using the securing means 54.

In the next step, the user grasps both the handle and connecting means 12 and 14 such that the second portion 22 and connecting means 14 are held in a vertical direction. The user then pulls back on the second portion 22 of the handle means 12 while maintaining the first portion 20 at a substantially constant position. This pulling, or pivoting, action is in a slow, steady manner away from the immobile platform 62 or 70. Once maximum rearward rotation of the shoulder is achieved, the user holds the arm in position for a selected period of time and then, in a slow and steady manner, rotates his or her arm in a forward direction.

To exercise other muscles, the user can rotate the device so that the second portion 22 of the handle means 12 and connecting means 14 are held in a horizontal direction. Once again, the user pulls, or pivots, the device as described above in a slow, steady manner away from the immobile platform 62 or 70. Once maximum rearward movement of the arm is achieved, the user holds the arm in position for a selected period of time and then, in a slow and steady manner, permits it to move in a forward direction. The user may hold the second portion 22 and connecting means 14 with his or her hand such that his or her palm is facing up or down so as to exercise different muscle groups of the body.

After a period of exercise, the user can increase or decrease the level of exercise by utilizing a different bias means 16 or by adjusting the overall weight of those counterweights 68 employed. This adjustment procedure causes an increase or decrease in the resistive force.

To exercise the muscles of the other side of the body, the user merely reverses how he or she is grasping the handle and connecting means 12 and 14 and repeats the above exercises.

It will be understood that certain changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. An exercise device comprising:

a.) a handle means having a first portion extending longitudinally along a first axis and a second hollow tubular portion extending longitudinally along a second axis, said first axis and said second axis being substantially perpendicular to each other said second portion being affixed to said first portion such that said first and second portions each provide a means for grasping said exercise device, said grasping means being configured so that said first portion of said handle means can be fixably held in position to provide an axis for pivotal movement between said first and second portions of said exercising device, said axis for pivotal movement being substantially coaxial with said longitudinal axis of said first portion, said first axis of said first portion of said handle means and said second axis of said second end of said second portion of said handle means being substantially perpendicular to each other;

b.) a means for connecting said handle means to a counterweight system, said connecting means being telescopically positioned within said hollow interior of said second portion of said handle means, a portion of said connecting means that is proximal to said handle means when said connecting means is positioned in said handle means including a first securing means for securing said connecting means at a selected position relative to said handle means, a portion of said connecting means that is distal to said handle means when said connecting means is positioned in said handle means including a second securing means, said second securing means securing said connecting means to said counterweight system, said connecting means being extensible and retractable within said hollow interior of said handle means; and c.) said counterweight system including an counterweight slidably positioned on a platform, a wire means having one end operatively connected to said counterweight and an opposite end operatively connectable and disconnectable to and from said connecting means, said counterweight system providing a tensioning force in said wire means when said wire means is connected to said counterweight and said connecting means, and said connecting means is moved.

2. The apparatus of claim 1 wherein said first securing means of said connecting means includes a series of apertures positioned along the length of said connecting means.

3. The apparatus of claim 2 wherein said handle means further includes a locking means, said locking means cooperating with said first securing means of said connecting means to lock said handle means and said connecting means in relative disposition.

4. The apparatus of claim 3 said first securing means of said connecting means further includes a spring-loaded pin positioned in each of said apertures, said pins cooperating with said locking means of said handle means to secure said handle means and said means for connecting said handle means to a bias means in relative disposition.

5. The apparatus of claim 3 wherein said locking means includes an aperture extending through said second portion of said handle means and a pin means sized and shaped to be positionable in said aperture in said handle means and at least one of said apertures in said connecting means.

6. The apparatus of claim 1 wherein said means for securing said connecting means to said counterweight system includes an aperture sized and shaped to receive said end of said wire means of said counterweight system that is operatively connectable and disconnectable to and from said connecting means.

7. The apparatus of claim 6 wherein said exercise apparatus includes a shackle means, said shackle means permitting connection of said wire means to and from said connecting means.

8. The apparatus of claim 1 wherein said counterweight has a weight that can be increased or decreased to provide adjustment of said tensioning force.

* * * * *